US005193510A

United States Patent [19]

Straubel

[11] Patent Number: 5,193,510

[45] Date of Patent: Mar. 16, 1993

[54] DEVICE FOR ADJUSTING THE ONSET OF SUPPLY FOR A FUEL INJECTION PUMP

[75] Inventor: Max Straubel, Stuttgart, Fed. Rep. of Germany

[73] Assignee: Robert Bosch GmbH, Stuttgart, Fed. Rep. of Germany

[21] Appl. No.: 895,056

[22] Filed: Jun. 8, 1992

[30] Foreign Application Priority Data

Jun. 6, 1991 [DE] Fed. Rep. of Germany ..... 4118555

[51] Int. Cl.[5] ..... F02M 37/04

[52] U.S. Cl. ..... 123/502; 123/501; 123/509

[58] Field of Search ..... 123/502, 501, 509, 495, 123/507, 508

[56] References Cited

U.S. PATENT DOCUMENTS

| | | | |
|---|---|---|---|
| 2,863,438 | 12/1958 | Challis | 123/502 |
| 3,859,973 | 1/1975 | Dreisin | 123/502 |
| 4,249,499 | 2/1981 | Perr | 123/502 |
| 4,407,241 | 10/1983 | Butler | 123/501 |
| 4,419,977 | 12/1983 | Hillebrand | 123/502 |
| 4,422,424 | 12/1983 | Luscomb | 123/502 |
| 4,494,514 | 1/1985 | Augustin | 123/502 |
| 4,617,903 | 10/1986 | Heberlee | 123/502 |
| 4,625,700 | 12/1986 | Elsbett | 123/501 |
| 4,760,831 | 8/1988 | Altdorf | 123/509 |
| 4,790,731 | 12/1988 | Freudenschuss | 123/502 |

*Primary Examiner*—Carl S. Miller

*Attorney, Agent, or Firm*—Edwin E. Greigg; Ronald E. Greigg

[57] ABSTRACT

The invention relates to a device for adjusting the supply onset of a fuel injection pump for internal combustion engines, by means of which the injection onset is adjustable in several stages. A roller tappet provided with a hydraulic tappet chamber for prestroke variation is fixable in defined positions via a control fluid. To this end the roller tappet has at least one first control bore and one second control bore communicating with the tappet chamber and can be made to communicate with openings in a housing bore that receives the tappet. The control bores are provided at differing heights, and/or with differing diameters or are offset from one another, at least one of the these control bores is closable by means of a control piston of the hydraulic tappet, and the control bores are openable as a function of an engine parameter via hydraulic lines.

19 Claims, 3 Drawing Sheets

DEVICE FOR ADJUSTING THE ONSET OF SUPPLY FOR A FUEL INJECTION PUMP

BACKGROUND OF THE INVENTION

The invention is based on a device for adjusting the onset of the supply for a fuel injection pump, in particular an in-line injection pump or plug-in pump.

Devices for adjusting the supply onset of this kind have already been known for a long time. In a known fuel injection pump having this kind of device for adjusting the onset of the hydraulic supply (German Auslegeschrift 1 107025), an adjusting piston that can be acted upon by the pressure of a control fluid is present inside the drive tappet. The delivery of the control fluid is done via a conduit arrangement having a delivery conduit in the pump housing. Besides the delivery conduit discharging into a guide bore of the drive tappet, this arrangement has a radial connecting bore, drilled through the wall of the drive tappet, to the pressure chamber of the device for adjusting the onset of the supply. At bottom dead center of the pump piston, these connecting bores face one another, so that the control fluid, which is under control pressure, can flow into the pressure chamber inside the drive tappet. In this known arrangement, the pressure of the control fluid must overcome the initial tension of the tappet spring that loads the adjusting piston. Depending on the magnitude of the fluid pressure, the adjusting piston and simultaneously the pump piston are raised relative to the drive tappet, so that in the ensuing compression stroke and with the previously interrupted communication between the delivery conduit and the connecting bore, an earlier supply onset by the pump piston is controlled than if the fluid pressure had not raised the adjusting piston.

In other known devices of this type (German Offenlegungsschrift 3 409 295, German Patent 3 510 223, German Offenlegungsschrift 3 742 831 and Japanese Patent 47-28016), a forward shift of the injection onset, as is necessary for various engine operating states, is achieved by hydraulically varying the prestroke of the pump piston. Some of these versions necessitate relatively major engineering expense, but on the other hand they also enable only a two-point adjustment of the pump piston. To create an injection onset that can be varied during operation as well as as a function of engine parameters is not made possible by these injection adjusters, since a pressure-dependent, infinitely graduated control has overly large tolerances.

OBJECT AND SUMMARY OF THE INVENTION

It is a principal object of the invention to provide an adjusting device for the supply onset for a fuel injection pump having the advantage over the prior art that at economical cost and using component groups known per se, the opportunity of establishing at least a three-state control of the hydraulic tappet is created.

This invention meets the demand for improving the emission figures of the engine in various operating states. Moreover, with corresponding additional expense, still other control bores can be made, with a certain offset from one another, in order to obtain the most various prestroke distances. It is essential to the invention that the roller tappet has at least two control bores, which communicate with the hydraulically controllable hydraulic tappet chamber and with the control openings of the housing bore, and, in terms of the longitudinal piston axis, the control bores are offset from one another at different heights and/or with different diameters, and at least one of these control bores is closable by the control piston of the hydraulic tappet; the various control bores are acted upon by control fluid under pressure, or relieved, as a function of engine operating parameters, such as the engine rpm and/or acceleration and/or temperature.

The invention will be better understood and further objects and advantages thereof will become more apparent from the ensuing detailed description of a preferred embodiment taken in conjunction with the drawings.

DESCRIPTION OF THE PREFERRED EMBODIMENT

Figure 1:
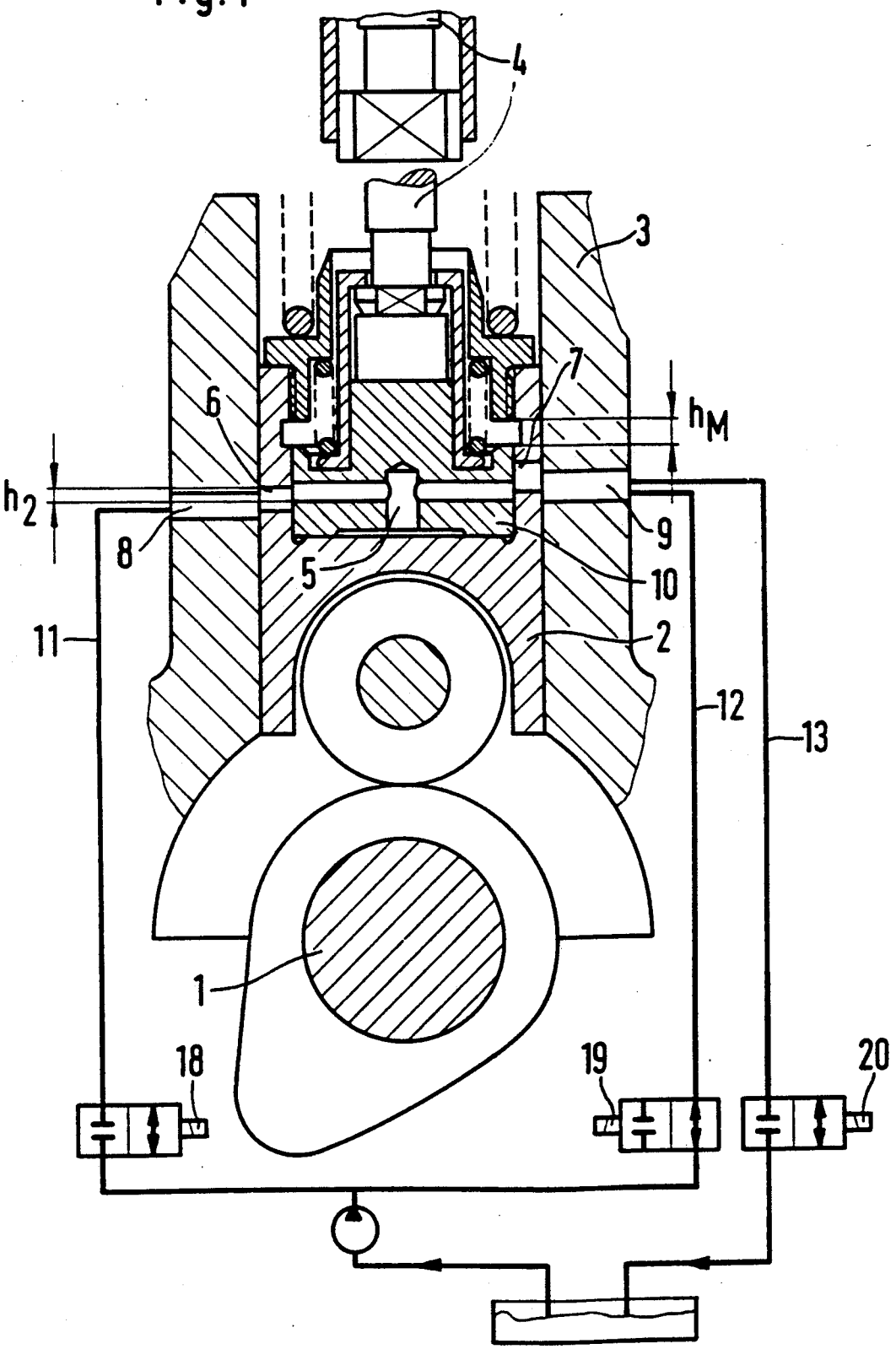
FIG. 1 shows a section through a roller tappet embodied as a hydraulic tappet.

As shown in FIG. 1, a control piston 10 and a hydraulic tappet chamber 5 are provided in a roller tappet 2; the control piston 10, depending on the imposition of pressure as a function of engine operating parameters, is capable of closing at least one control bore in the roller tappet 2, in this case the bore 6.

Triggering of the hydraulic tappet via the control bores 6 and 7 is effected via openings and 9 in the wall of a housing bore 3 and hydraulic lines 11, 12 and 13 that adjoin the openings 8 and 9. If a suitable multi-way valve is used, such as that shown in FIG. 3, then the lines 12 and 13 can be combined into a single line 15. The possibility also exists, as schematically suggested in FIG. 2, of triggering a plurality of pump elements simultaneously via lines 17.

The mode of operation will now be described in further detail in terms of various pressure impositions upon the various control bores 6 and 7, referring to FIG. 1 Various control positions of magnet valves 18, 19 and 20, which are disposed in the lines 11, 12 and 13, are assumed, so that their action upon the desired prestroke Will be more clearly understood. If the magnet valves 18 and 19 are closed and the return via the magnet valve 20 is opened, then the hydraulic tappet chamber 5 can be evacuated until such time as the control piston 10 is on its seat; as a consequence, because of a resultant idle stroke, the supply onset ensues later. This position of the magnet valve is selected upon warm starting. Contrarily, if the magnet valve 18 and the magnet valve 20 and thus the return via the line 13 are closed, and the magnet valve 19 is opened (switching position as shown in FIG. 1), so that a pressure imposition takes place via the line 12 and the control bore 7, then the control piston 10 lifts from its seat. This control position of the valve causes a shift of the supply onset to early, if used in cold starting or during operation at high rpm.

In another control position of the magnet valves, the control bore 6 is acted upon by pressure through the opened magnet valve 18 via the line 11, while the other two magnet valves 19 and 20 are closed. In this valve control position, the control piston 10 is raised only until it has closed the control bore 6 with its control edge, thereby establishing a mean prestroke. The prestroke thereby established is dictated directly by the geometric relationship of the control bores 6 and 8. The mean and maximum prestroke that can be established in accordance with the aforementioned valve control positions are marked $h_2$ and $h_M$ in FIG. 1. The electrical triggering of the magnet valve is effected via a control device, not shown in further detail, as a function of operating characteristics, such as the engine rpm and/or engine temperature and/or engine acceleration.

Figure 2:
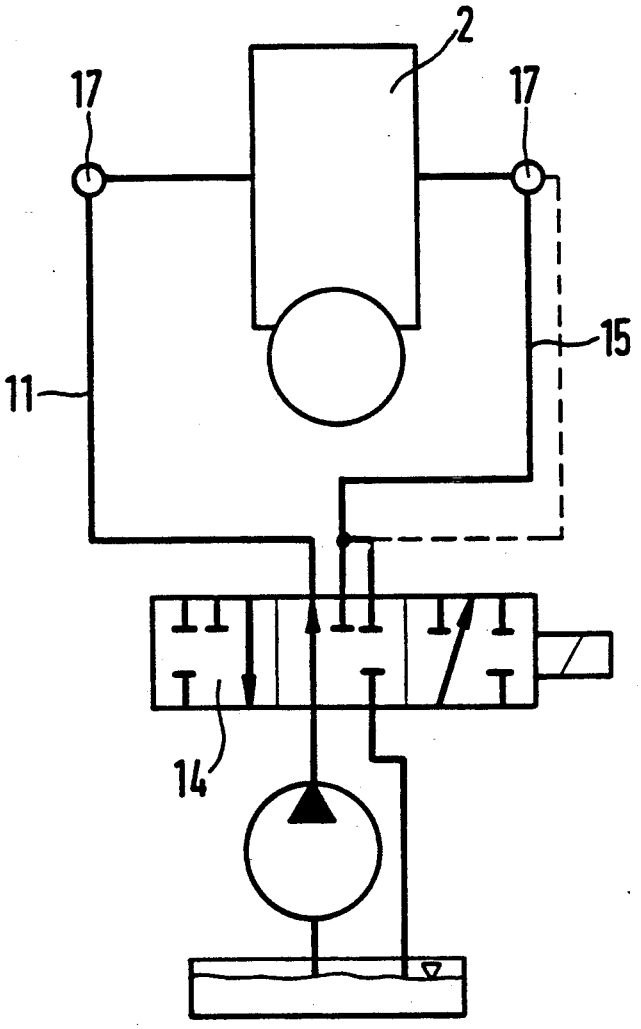
FIG. 2 illustrates control via a 5/3-multiway valve.
Figure 3:
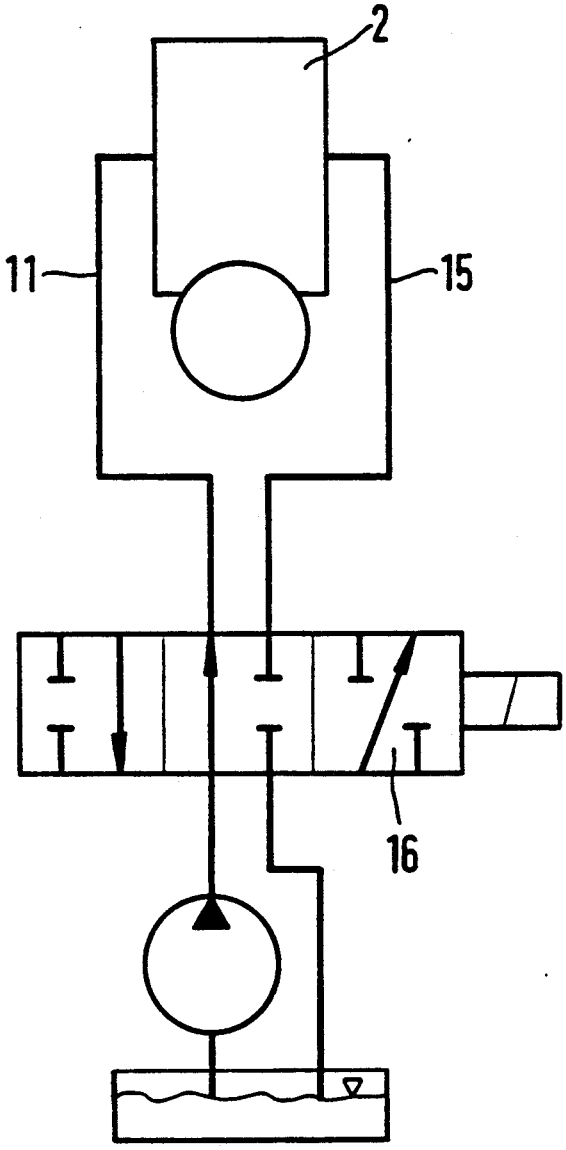
FIG. 3 shows control via a 4/3-multiway valve, in each case schematically.

Instead of the lines 12 and 13 shown in FIG. 1 and their control by means of 2/2-way valves, only a single line 15 may be used, as shown in FIGS. 2 and 3, instead of the two lines; in that case, corresponding multiposition valves, such as a 5/3-way magnet valve 14 of FIG. 2 or a 4/3-way magnet valve 16 of FIG. 3 are required.

The foregoing relates to a preferred exemplary embodiment of the invention, it being understood that other variants and embodiments thereof are possible within the spirit and scope of the invention, the latter being defined by the appended claims.

I claim:

1. An adjusting device for the onset of the supply of a fuel injection pump, in particular an in-line injection pump or plug-in pump for internal combustion engines, in which a reciprocating motion of a pump piston (4), effected via a drive cam (1), is transmitted via a roller tappet (2) that is guided in a housing bore (3) and for varying the prestroke the roller tappet is provided with a hydraulic tappet chamber (5), said roller tappet being fixable in defined stroke positions by means of variable action of a control fluid, the improvement comprising the roller tapper (2) has at least one first control bore (6) and at least one second control bore (7), which bores communicate with the hydraulically controllable hydraulic tappet chamber (5) and respectively with means defining openings (8, 9) in the wall of the housing bore (3), the hydraulic tappet includes a control piston (10) said at least one first and second control bores (6, 7) are provided offset from one another with respect to the longitudinal piston axis, at least one of said at least one first and second control bores is closable by means of said control piston, and said openings (8, 0) in the wall of the housing bore (3) are supplied selectively as a function of at least one of the engine rpm, engine acceleration and engine temperature with the control fluid via hydraulic lines (11, 12, 13 or 11, 15).

2. A device for adjusting the supply onset as defined in claim 1, further wherein the control bores (6, 7) are provided also with differing diameters.

3. A device for adjusting the supply onset, as defined by claim 1, further wherein the control piston (10) maintains said at least one second control bore (7) open at all times, and for cold starting or high engine rpm, the at least one second control bore (7) can be acted upon by control fluid, while contrarily the other at least one first control bore (6) is blocked.

4. A device for adjusting the supply onset, as defined by claim 2, further wherein the control piston (10) maintains said at least one second control bore (7) open at all times, and for cold starting or high engine rpm, the at least one second control bore (7) can be acted upon by control fluid, while contrarily the other at least one first control bore (6) is blocked.

5. A device for adjusting the supply onset as defined by claim 1, further wherein for warm engine starting, none of the control bores (6, 7) is acted upon by control fluid and the hydraulic tappet chamber (5) is pressure-relieved via line means.

6. A device for adjusting the supply onset as defined by claim 2, further wherein for warm engine starting, none of the control bores (6, 7) is acted upon by control fluid and the hydraulic tappet chamber (5) is pressure-relieved via line means.

7. A device for adjusting the supply onset as defined by claim 1, further wherein in at least one intermediate position, the at least one first control bore (6), which is controllable by the control piston (10) of the roller tappet (2), can be acted upon via control fluid, while contrarily the other control bores are closed.

8. A device for adjusting the supply onset as defined by claim 2, further wherein in at least one intermediate position, the at least one first control bore (6), which is controllable by the control piston (10) of the roller tappet (2), can be acted upon via control fluid, while contrarily the other control bores are closed.

9. A device for adjusting the supply onset as defined by claim 3, further wherein in at least one intermediate position, the at least one first control bore (6), which is controllable by the control piston (10) of the roller tappet (2), can be acted upon via control fluid, while contrarily the other control bores are closed.

10. A device for adjusting the supply onset as defined by claim 1, further wherein each of the hydraulic lines (11, 12, 13) connected to the control bores (6, 7) is controllable by means of a separate 2/2-way valve.

11. A device for adjusting the supply onset as defined by claim 2, further wherein each of the hydraulic lines (11, 12, 13) connected to the control bores (6, 7) is controllable by means of a separate 2/2-way valve.

12. A device for adjusting the supply onset as defined by claim 1, further wherein all the hydraulic lines (11, 12, 13) that supply the control bores (6, 7) with control fluid are opened via a common 5/3-way valve.

13. A device for adjusting the supply onset as defined by claim 2, further wherein all the hydraulic lines (11, 12, 13) that supply the control bores (6, 7) with control fluid are opened via a common 5/3-way valve.

14. A device for adjusting the supply onset as defined by claim 1, further wherein the hydraulic lines (12, 13) are combined into the one lines (15), and the control is effected by means of a 4/3-way valve (16).

15. A device for adjusting the supply onset as defined by claim 2, further wherein the hydraulic lines (12, 13) are combined into one line (15), and the control is effected by means of a 4/3-way valve (16).

16. A device for adjusting the supply onset as defined by claim 3, further wherein the hydraulic lines (12, 13) are combined into one line (15), and the control is effected by means of a 4/3-way valve (16).

17. A device for adjusting the supply onset as defined by claim 4, further wherein the hydraulic lines (12, 13) are combined into one line (15), and the control is effected by means of a 4/3-way valve (16).

18. A device for adjusting the supply onset as defined by claim 7, further wherein the hydraulic lines (12, 13) are combined into one line (15), and the control is effected by means of a 4/3-way valve (16).

19. A device for adjusting the supply onset as defined by claim 13, further wherein the hydraulic lines (12, 13) are combined into one line (15), and the control is effected by means of a 4/3-way valve (16).

* * * * *